US008727320B1

(12) United States Patent
Franta

(10) Patent No.: US 8,727,320 B1
(45) Date of Patent: May 20, 2014

(54) BEARING LESS BLOCK

(76) Inventor: John E. Franta, Mesa, AZ (US)

( * ) Notice: Subject to any disclaimer, the term of this patent is extended or adjusted under 35 U.S.C. 154(b) by 0 days.

(21) Appl. No.: 13/506,229

(22) Filed: Apr. 5, 2012

Related U.S. Application Data

(60) Provisional application No. 61/516,501, filed on Apr. 5, 2011.

(51) Int. Cl.
*B66D 3/08* (2006.01)

(52) U.S. Cl.
USPC ..... 254/393; 254/389; 254/401

(58) Field of Classification Search
USPC ..... 254/389, 393, 401, 402, 405, 409, 410
See application file for complete search history.

(56) References Cited

U.S. PATENT DOCUMENTS

| | | | | | |
|---|---|---|---|---|---|
| 329,667 | A * | 11/1885 | Moore | ..... | 254/404 |
| 1,477,639 | A * | 12/1923 | Fishback | ..... | 254/402 |
| 1,713,587 | A * | 5/1929 | Wright | ..... | 254/409 |
| 4,325,537 | A * | 4/1982 | Winter et al. | ..... | 254/405 |
| 4,676,484 | A * | 6/1987 | Reed | ..... | 254/402 |
| 5,154,401 | A * | 10/1992 | Schramm et al. | ..... | 254/416 |
| 5,792,294 | A * | 8/1998 | Randazzo et al. | ..... | 156/94 |
| 6,041,476 | A * | 3/2000 | deNormand | ..... | 16/197 |
| 6,305,669 | B1 * | 10/2001 | Harken et al. | ..... | 254/412 |
| 6,684,805 | B2 * | 2/2004 | Curchod | ..... | 114/218 |
| 7,431,269 | B2 * | 10/2008 | Carlson et al. | ..... | 254/405 |
| 7,533,870 | B2 * | 5/2009 | Camrass et al. | ..... | 254/405 |
| 7,673,851 | B2 * | 3/2010 | Lange | ..... | 254/409 |
| 7,735,809 | B2 * | 6/2010 | Maire | ..... | 254/396 |
| 2005/0263748 | A1 * | 12/2005 | Smith | ..... | 254/409 |

* cited by examiner

*Primary Examiner* — Emmanuel M Marcelo
(74) *Attorney, Agent, or Firm* — Ronald R. Kilponen

(57) ABSTRACT

A single and double bearing less block is shown and described. The blocks can be used in block and tackle applications or anywhere a mechanical advantage is needed for a line. The blocks are designed to provide a slippery surface for the lines that are being retained and which thereby allows easy adjustment without the use of bearings or moving parts. The blocks also have ears with holes through which a retainer or smaller line can be tied to help retain the line in the block when the line is not under tension. Alternatively the retainer can be inserted through the holes and can be used to secure both a lashing and the line to the blocks when the blocks are used in alternative applications.

6 Claims, 6 Drawing Sheets

BEARING LESS BLOCK

CROSS REFERENCE TO RELATED APPLICATIONS

This application claims the benefit of Provisional application for Patent Ser. No. 61/516,501 filed on Apr. 5, 2011.

FIELD

The present version of these embodiments relate generally to the field of devices used to secure lines or provide force to lines with block and tackle systems.

BACKGROUND

Mankind has needed to lift heavy things throughout history. When the things that needed lifting were more than a single man or group of men could lift, mankind designed machines for lifting. One of those machines was the block and tackle. A significant mechanical advantage could be obtained by using blocks with rotating pulleys linked together with rope or line tackle. There are limitations to the number of pulleys that one can put in a block as at some point, the friction from the line and pulleys in the blocks cannot be overcome. The industry then began using bearings in the pulleys. While this did reduce the friction in the block and tackle systems even a bearing system had frictional limitations.

Many new advances have been made in the rope or line industry. Some of the new lines available are very slippery. Applicant recognized this and has designed a new type of block and tackle system that takes advantage of the slickness of the rope or line. This new block does not need bearings to function and can provide mechanical advantage with much simpler components and fewer moving parts.

SUMMARY

In view of the foregoing disadvantages inherent in the field of block and tackle systems there is a need for a new bearing less block that can be used in many different applications.

A first objective of these embodiments is to provide a device that can be used in a block and tackle system.

Another objective of these embodiments is to provide a device that is relatively simple to manufacture.

It is yet another objective of these embodiments to provide a device that can be used with many different attachment systems for mechanical advantage.

It is a still further object of these embodiments to provide a device that is smooth and does not require bearings or moving parts.

These together with other objectives of these embodiments, along with various features of novelty which characterize these embodiments, are pointed out with particularity in this application forming a part of this disclosure. For a better understanding of these embodiments, the operating advantages and the specific objectives attained by its uses, reference should be had to the accompanying drawings and descriptive matter in which there is illustrated a preferred embodiment.

DETAILED DESCRIPTION OF THE PREFERRED EMBODIMENTS

Figure 1:
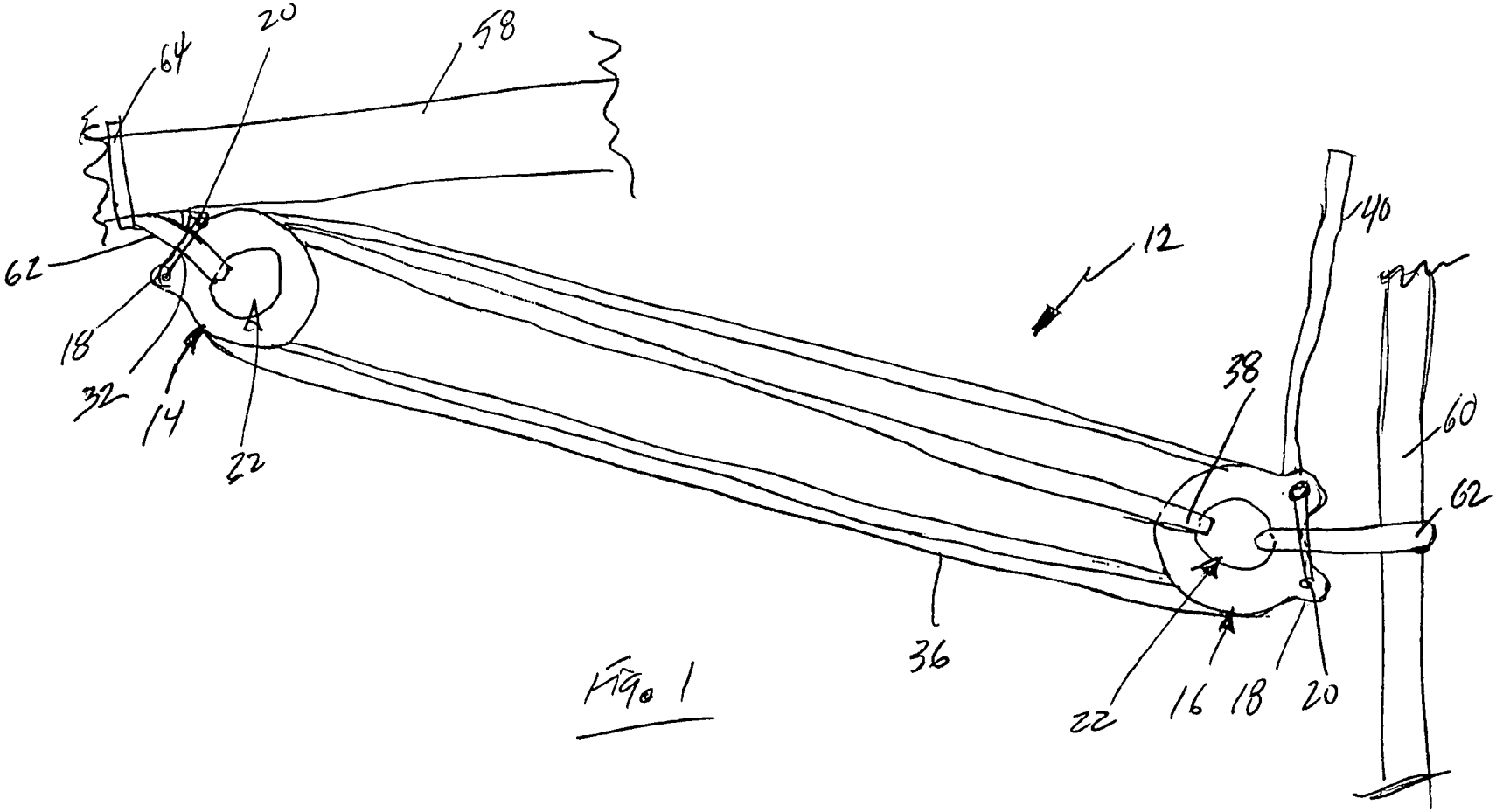
FIG. 1 shows a side view of one embodiment of a block and tackle system between two posts.

Referring to the drawings in detail wherein like elements are indicated by like numerals, there is shown in FIG. 1 a block and tackle system 12. The block and tackle system 12 can be used to connect two pieces of hardware such as first post 58 and second post 60 in this example. First block 14 is located near first post 58. A soft shackle 62, as an example, can be looped through center hole 22 and around the loop 64 that is around first post 58. A retainer 32 is fed through each of the holes 20 of the ears 18 of the first block 14 to retain the soft shackle 62 to the first block 14. The line 36 is affixed to second block 16 with splice 38 through the center hole 22 of the second block 16. The line 36 wraps around the first block 14 in the first surface 24 and returns to the second block 16 first surface 24. The line returns to the first block 14 where it wraps around the second surface 26 and returns to the second block 16 and wraps around the second surface 26 where end 40 can be pulled and then retained by devices known in the art or even tied off. This thereby provides mechanical advantage to the line 36 which is retained between the first post 58 and second post 60 thereby holding these two posts fixed relative to one another. Obviously, this block and tackle system could be used in many other applications.

The first and second blocks 14, 16 are preferably made from aluminum and preferably have a hard coat anodized finish. This creates the slippery surfaces for less friction between the line and blocks. It is also possible to use a polymer for blocks 14, 16 to obtain the same, similar or better slickness. The combination of the hard coat anodized aluminum combined with the line 36 provides a relatively low friction interface.

Figure 2:
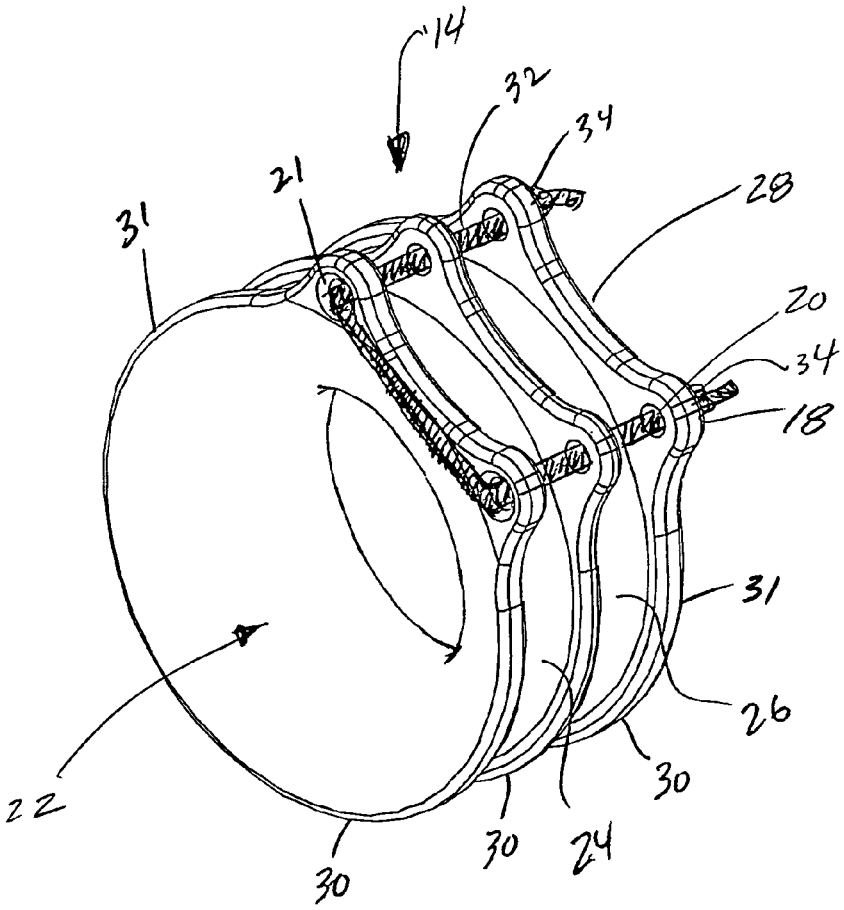
FIG. 2 shows a side perspective view of one embodiment of a double block with retainer.

FIG. 2 shows a perspective view of a double block 14. As can be seen there are three pairs of ears 18, one pair on the outer edge 31 of outer surface or lip 30, one pair between the first and second surfaces 24, 26 on lip 30 and a third pair on the opposite outer edge or lip 30. Each of the ears 18 has a hole 20 and the holes 20 are approximately co-linear to one another. The holes 20 can also have chamfers 21 which aids the insertion of the retainer 32 and helps prevent premature wear. The ears 18 are approximately co-linear to one another.

Figure 4:
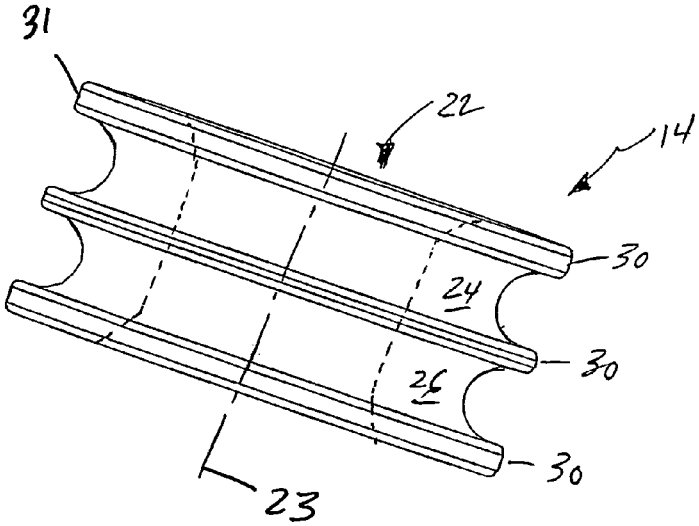
FIG. 4 shows an edge view of one embodiment of the double block.

The first and second surfaces 24, 26 have a radius to them that aids in capturing the line 36, best seen in FIG. 4. This relatively large radius allows the line 36 to slide in the first and second surfaces 24, 26 with relative ease and does not fold up the line to the point that the material properties of the line are compromised. The surfaces 24, 26 are also relatively deep, curved and inset from the outer edges 31 of lips 30. This aids in keeping the line 36 captured by the blocks. The center hole 22 is also smoothly finished, FIGS. 2, 4.

Figure 3:
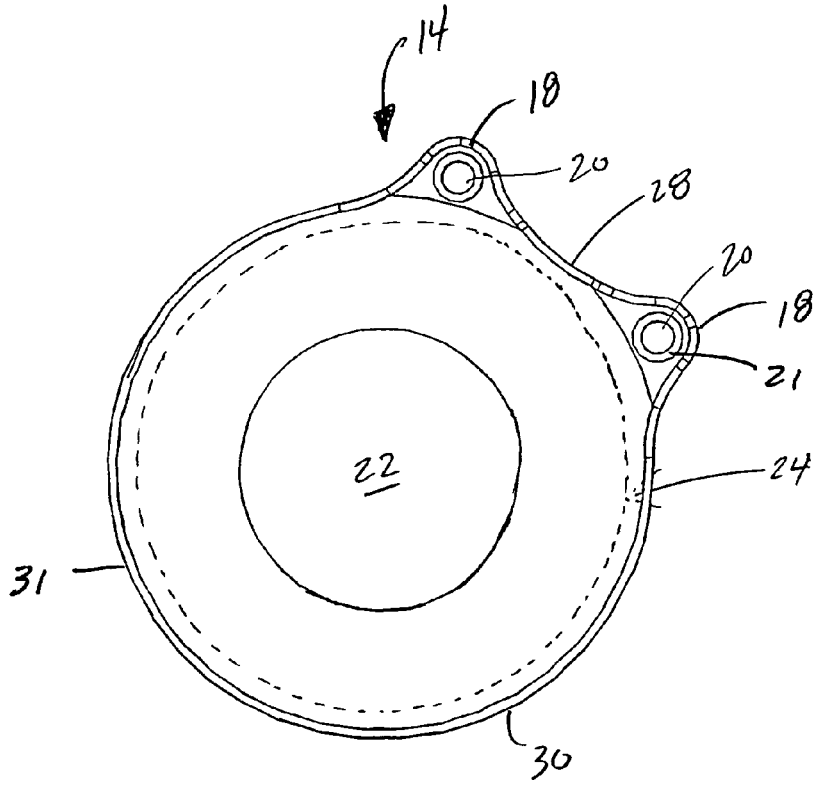
FIG. 3 shows a side view of one embodiment of the double block.

FIG. 3 shows more clearly the hole 20 with chamfer 21 in the ear 18. The large diameter of surface 24 can also be seen.

FIG. 4 shows more details of the first and second surfaces 24, 26 of double block 14. The smooth surface of center hole 22 can be seen. It should be noted that first and second surface

24, 26 have a circular profile and are inset from the outer edge 31 of lips 30 providing a relatively deep and smooth surface for the line 36 to contact. Also seen is center axis 23.

Figure 5:
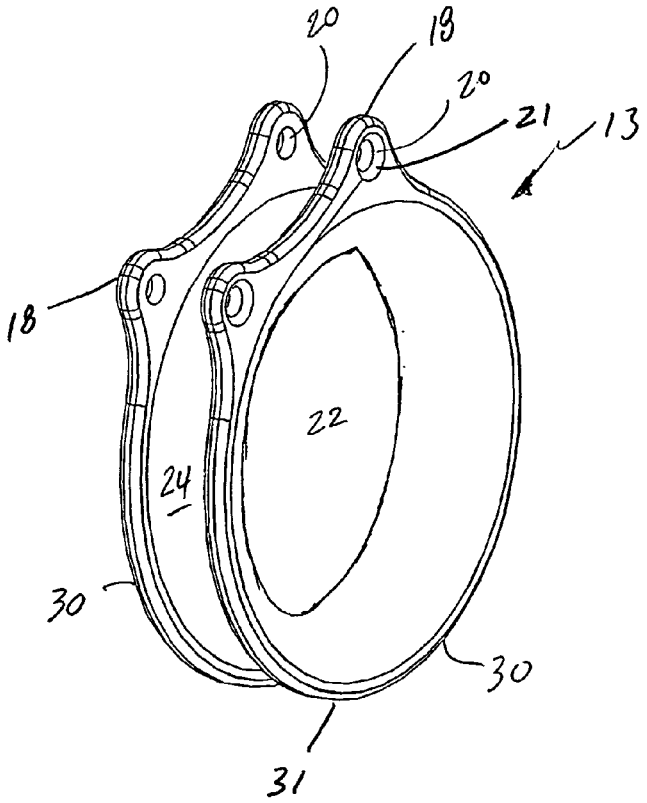
FIG. 5 shows a side perspective view of one embodiment of the single block.

FIG. 5 shows one embodiment of a single surface 24 single block 13. This single block 13 likewise has a pair of ears 18 with hole 20 in each and the holes 20 and ears 18 are approximately co-linear.

Figure 6:
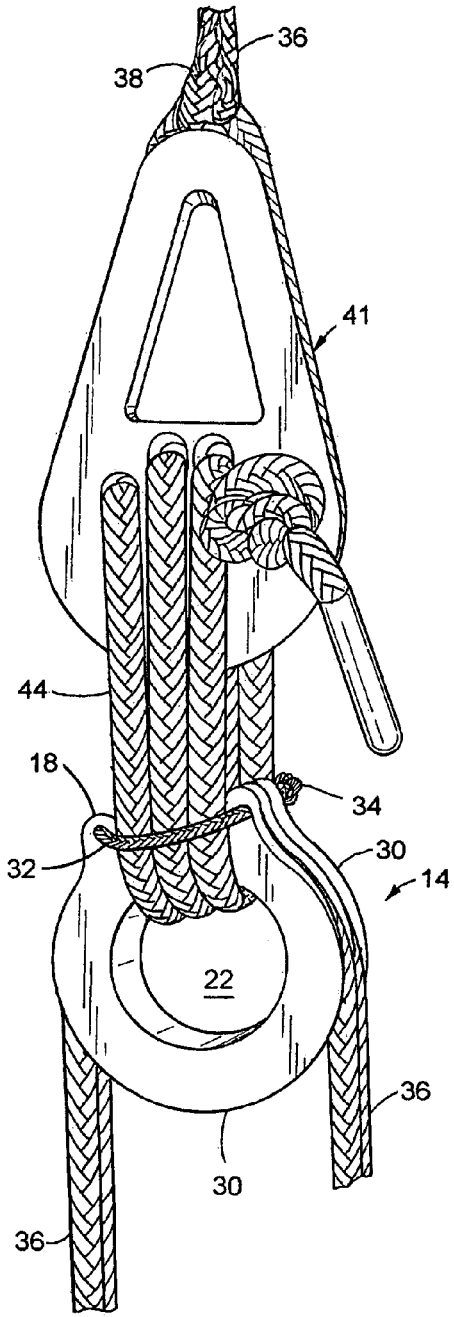
FIG. 6 shows a perspective view of another application of the double block.

FIG. 6 shows another application for a double block or first block 14. In this example, a lashing 44 is used to secure the block 14 to a line end fitting 41. The line end fitting 41 is secured to line 36' with a splice 38. The lashing 44 is fed through the holes in the end fitting 41 and through the center hole 22 of the first block 14. The lashing 44 is retained in the end fitting 41 with a knot. A retainer 32 is used to secure the lashing 44 near the inner surface of center hole 22. The retainer 32 is also secured to the ears 18 by knots 34. The line 36 in block 14 can then be used to tighten the end fitting 41 and line 36' to the fixed attachment point (not shown) while obtaining mechanical advantage in so doing.

It will now be apparent to those skilled in the art that other embodiments, improvements, details and uses can be made consistent with the letter and spirit of the foregoing disclosure and within the scope of this application, which is limited only by the following claims, construed in accordance with the patent law, including the doctrine of equivalents.

What is claimed is:

1. A device for providing mechanical advantage to line, the device comprising:

a ring shaped block, the block having a center hole with central axis, the center hole having a smooth arced surface with the arc bending away from the center axis;

a pair of circumferential lips around the center hole, each lip having an outer edge and an inner edge, a surface between the inner edges of the lips, the surface having a concave curved circumferential profile around the center hole;

a first and second pair of ears on each lip, each ear having a hole, each hole having an axis there through, each hole having a chamfer on the outer edge, the ears and holes on each lip approximately co-linear to one another, the axis of the holes approximately parallel to the central axis.

2. The device of claim 1 further comprising:

a retainer inserted into one hole of the first ear and through the co-linear hole of the second ear, a knot tied on each end of the retainer, a second retainer inserted into the other hole of the first ear and through the co-linear hole of the second ear, a knot tied on each end of the retainer.

3. The device of claim 1 further comprising:

a retainer inserted into one hole of the first ear and through the co-linear hole of the second ear, the retainer inserted through the adjacent hole of the second ear and back and through the co-linear hole on the first ear, where each end of the retainer is knotted on the outer edge.

4. A device for providing mechanical advantage to line, the device comprising:

a hollow cylindrically shaped block, the block having a center hole, the center hole having a central axis, the center hole having a smooth surface arcing away from the central axis;

the block having a lip on one outer surface, the lip having an outer edge, a second lip on the opposite outer surface, the lip having an outer edge, a central lip having an outer edge, the central lip located between the first and second lip, each lip having a pair of ears on the outer edges, each ear having a thru hole, each pair of ears arranged circumferentially on the outer edges such that one of each pair of the holes are co-linear with one of another ear holes;

a first surface located between one outer lip and the central lip, the surface circumscribing the center hole, the first surface having a smooth concave surface;

a second surface between the opposite outer lip and the central lip, the surface circumscribing the center hole, the second surface having a smooth concave surface.

5. The device of claim 4 further comprising:

a retainer inserted into the hole of the first lip ear and through the hole of the co-linear central ear and through the hole of the co-linear second lip ear, a knot tied on each end of the retainer, a second retainer inserted into the hole of the adjacent first lip ear and through the hole of the co-linear central ear and through the hole of the opposite co-linear second lip ear, a knot tied on each end of the retainer.

6. The device of claim 4 further comprising:

a retainer inserted into the hole of the first lip ear on the first outer surface and through the co-linear hole of the central ear and through the hole in the opposite outermost second lip ear on the second outer surface, the retainer inserted through the adjacent second lip ear hole on the second outer surface and back and through the co-linear ear hole of the central ear and through the co-linear hole of the first lip ear, where each end of the retainer is knotted on the first outer surface.

* * * * *